US007596979B2

(12) United States Patent
Hebert

(10) Patent No.: US 7,596,979 B2
(45) Date of Patent: Oct. 6, 2009

(54) RING MILL APPARATUS AND METHOD

(75) Inventor: David Hebert, Shrewsbury, MA (US)

(73) Assignee: Firth Rixson, East Hartford, CT (US)

( * ) Notice: Subject to any disclaimer, the term of this patent is extended or adjusted under 35 U.S.C. 154(b) by 0 days.

(21) Appl. No.: 11/933,988

(22) Filed: Nov. 1, 2007

(65) Prior Publication Data

US 2009/0113971 A1 May 7, 2009

(51) Int. Cl.
*B21D 15/04* (2006.01)

(52) U.S. Cl. ..... 72/105; 72/106; 72/249; 72/453.02

(58) Field of Classification Search ..... 72/105, 72/106, 107, 110, 111, 249, 453.01, 453.02, 72/453.03, 453.04, 453.05, 453.06
See application file for complete search history.

(56) References Cited

U.S. PATENT DOCUMENTS

| | | | | |
|---|---|---|---|---|
| 2,925,003 | A | 2/1960 | McMullen et al. | |
| 2,930,266 | A * | 3/1960 | Kendall | 72/87 |
| 3,301,030 | A | 1/1967 | Brownstein | |
| 3,645,126 | A * | 2/1972 | Kralowetz et al. | 72/402 |
| 3,681,962 | A | 8/1972 | Marcovitch | |
| 3,709,011 | A * | 1/1973 | Wieting et al. | 72/9.5 |
| 3,765,202 | A * | 10/1973 | Bauknecht et al. | 72/94 |
| 3,803,890 | A | 4/1974 | Connell | |
| 3,839,887 | A | 10/1974 | Vieregge | |
| 3,969,801 | A * | 7/1976 | Dolenc et al. | 492/7 |
| 3,992,911 | A | 11/1976 | Connell | |
| 4,047,414 | A | 9/1977 | Druge | |
| 4,325,245 | A * | 4/1982 | Sherwood | 72/248 |
| 4,339,937 | A | 7/1982 | Strugala | |
| 4,454,739 | A | 6/1984 | Ciccorelli | |
| 4,510,781 | A | 4/1985 | Holt | |

(Continued)

FOREIGN PATENT DOCUMENTS

GB 218635 11/1924

(Continued)

OTHER PUBLICATIONS

Dy Yang; http://mdl.csa.com/partners/viewrecord.php?requester=gs&collection=TRD&recid=8508521488MD&q=ring+rolling+and+hydraulic+motor&uid=786929514&setcookie=yes Development of a New Computer-Aided Manufacturing System for the Hot Ring—Rolling Process, 3rd International conference on rotary metalworking processes (Kyoto, Japan, Sep. 8-10, 1984, po. 229-238.

(Continued)

*Primary Examiner*—Edward Tolan
(74) *Attorney, Agent, or Firm*—Baker & Hostetler LLP

(57) ABSTRACT

A ring mill apparatus and method utilizes at least one hydraulic or other direct drive motor to drive a roller in contact with a ring that is to be expanded by the ring mill. The motor may be two opposed radial piston hydraulic motors, to drive an upper king roller, which contacts the outside of the ring, which is inserted between the upper king roller and a lower mandrel roller, which contacts the inside of the ring. The lower mandrel roller is urged upwards against the ring by a ram driven carriage. Two hydraulic or other direct drive motors can be provided in-line with, and directly connected to, the king roller.

42 Claims, 2 Drawing Sheets

U.S. PATENT DOCUMENTS

| | | | | |
|---|---|---|---|---|
| 4,672,833 | A | 6/1987 | Bartko et al. | |
| 4,688,407 | A | 8/1987 | Schroder | |
| 4,785,647 | A | 11/1988 | Coleman | |
| 4,848,125 | A * | 7/1989 | Itou et al. | 72/105 |
| 4,864,838 | A * | 9/1989 | Engel et al. | 72/225 |
| 4,869,088 | A | 9/1989 | Kadotani | |
| 5,373,923 | A * | 12/1994 | Koenig | 188/382 |
| 5,419,032 | A | 5/1995 | Rytych | |
| 5,605,068 | A | 2/1997 | Yamasoto et al. | |
| 5,836,231 | A * | 11/1998 | Leinonen | 91/491 |
| 6,038,758 | A | 3/2000 | Kanai et al. | |
| 6,473,981 | B2 | 11/2002 | Dole | |
| 6,598,285 | B1 * | 7/2003 | Binggeli et al. | 29/509 |
| 6,755,239 | B2 | 6/2004 | Ray et al. | |
| 6,776,214 | B2 | 8/2004 | Ray et al. | |
| 6,968,720 | B2 | 11/2005 | Balagna et al. | |
| 6,978,546 | B2 * | 12/2005 | Andersson et al. | 29/898.066 |
| 7,121,129 | B2 * | 10/2006 | Binggeli | 72/110 |

FOREIGN PATENT DOCUMENTS

| | | |
|---|---|---|
| GB | 877579 | 9/1961 |
| JP | 2025236 | 1/1990 |

OTHER PUBLICATIONS

A. Alfozan and J. Gunasekera, Department of Mechanical Engineering, Ohio University, https://www.forging.org/FIERF/pdf/RingRollingMill.pdf; Development of an Experimental Ring Rolling Mill.

* cited by examiner

RING MILL APPARATUS AND METHOD

FIELD OF THE INVENTION

The invention relates to the field of metal rolling, and more particularly to devices and methods for forming a ring from a metal or alloy by vertically rolling the ring between rollers

BACKGROUND OF THE INVENTION

In many industries it is often desirable to form a large ring from various metal or alloy materials. Typically, in some examples, an initial hollow cylindrical ring is first manufactured, for example by forging and/or machining. In the case of some applications for the final ring, such as for example aerospace parts, the desired final rings may have large diameters and/or may be made of very high temperature alloys or superalloys. The initial hollow ring is then expanded to have a larger inner and outer diameter. One way of expanding a ring is by so-called vertical rolling, in which the ring is inserted so it is pinched with its thickness between two driven rollers. One of the rollers is driven and a compressive force is applied between the rollers so that the ring moves through the rollers and is squeezed as it goes around, thus gradually reducing the thickness of the ring while increasing its inner and outer diameters.

In the prior art, the driven roller has been driven by an electric motor. These systems have been found to be very satisfactory for some applications. However, the electric motor drives for the roller typically require gear reduction gearboxes and alignment couplings. For example, in one type of ring mill, a 500 hp motor might be reduced from 1800 RPM to 18 RPM to get a high torque output on the roller. In certain cases, such as for example in the case of very large installations to make very large parts using high force, the complexity, size and cost of the motor, gearbox, and alignment coupling structures can be undesirably expensive, complex, large, and expensive to produce and repair. This can be true for example in making parts such as combustion casings and fan cases, or other parts, for large aircraft engines. Also, in some cases the original part to be rolled is imperfectly round, and so the rolling process transmits vibrations through the rollers back through the coupling and gearbox. The couplings and gearboxes thus must be selected or made to accommodate this transmitted vibration, which leads to further cost and complexity of these parts. Therefore it would desirable to have a rolling mill that improves at least to some extent in some applications, upon the disadvantages of electric motor driven rolling ring mills. The direct drive motor can include for example a hydraulic motor, a brushless DC motor (with a permanent magnet design with electronic switching) or a superconductor motor.

SUMMARY OF THE INVENTION

Some embodiments of the invention provide a ring mill apparatus and method that utilize at least one direct drive motor to drive a roller in contact with the ring. The direct drive motor can include for example a hydraulic motor, a brushless DC motor (with a permanent magnet design with electronic switching) or a superconductor motor. The motor may be a radial piston hydraulic motor in some embodiments. Also, some embodiments more particularly use two opposed hydraulic or other direct drive motors. Some embodiments use the two opposed hydraulic or other direct drive motors to drive an upper king roller, which contacts the outside of the ring, and also use a lower mandrel roller, which contacts the inside of the ring. The lower mandrel roller in some cases may be laterally inserted inside the ring or retracted therefrom, and when inserted in a rolling position, is urged upwards against the ring by a ram driven carriage. In some examples, two hydraulic or other direct drive motors are provided in-line with, and directly connected to, the king roller. Also in some examples, an outer side of each hydraulic or other direct drive motor is restrained by a respective torque arm. Also in some embodiments, a pair of angled stabilizing swing arms urge respective support rollers on the outside of the ring which may in some cases reduce vibration and/or oscillation of the ring. The method in some embodiments includes using a hydraulic or other direct drive motor to rotate a roller in contact with a ring to expand the ring.

An aspect of the present invention provides in some examples a ring mill system to expand a ring, featuring: a first roller arranged to contact the outside of the ring; a second roller arranged to contact the inside of the ring; and a direct drive system connected to one of the first roller or the second roller to rotationally drive the connected roller. The direct drive system may be a hydraulic drive system.

Another aspect of the present invention provides in some examples a ring mill system to expand a ring, comprising: rotational means for contacting the outside of the ring; rotational means for contacting the inside of the ring; and a direct driving means connected to one of the first contacting means or the second contacting means for rotationally driving the connected contacting means. The direct drive means may be a hydraulic driving means.

A further aspect of the present invention provides in some examples a method of expanding a ring using a ring mill, comprising: contacting the outside of the ring with a first roller; contacting the inside of the ring with a second roller; and driving one of the first and second rings using a direct drive system connected to one of the first and second rollers. The direct drive system may be a hydraulic drive system.

An additional aspect of some embodiments provides a ring mill system to expand a ring, comprising a first roller arranged to contact the outside of the ring, a second roller arranged to contact the inside of the ring; and a hydraulic drive system connected to one of the first roller or the second roller to rotationally drive the connected roller.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
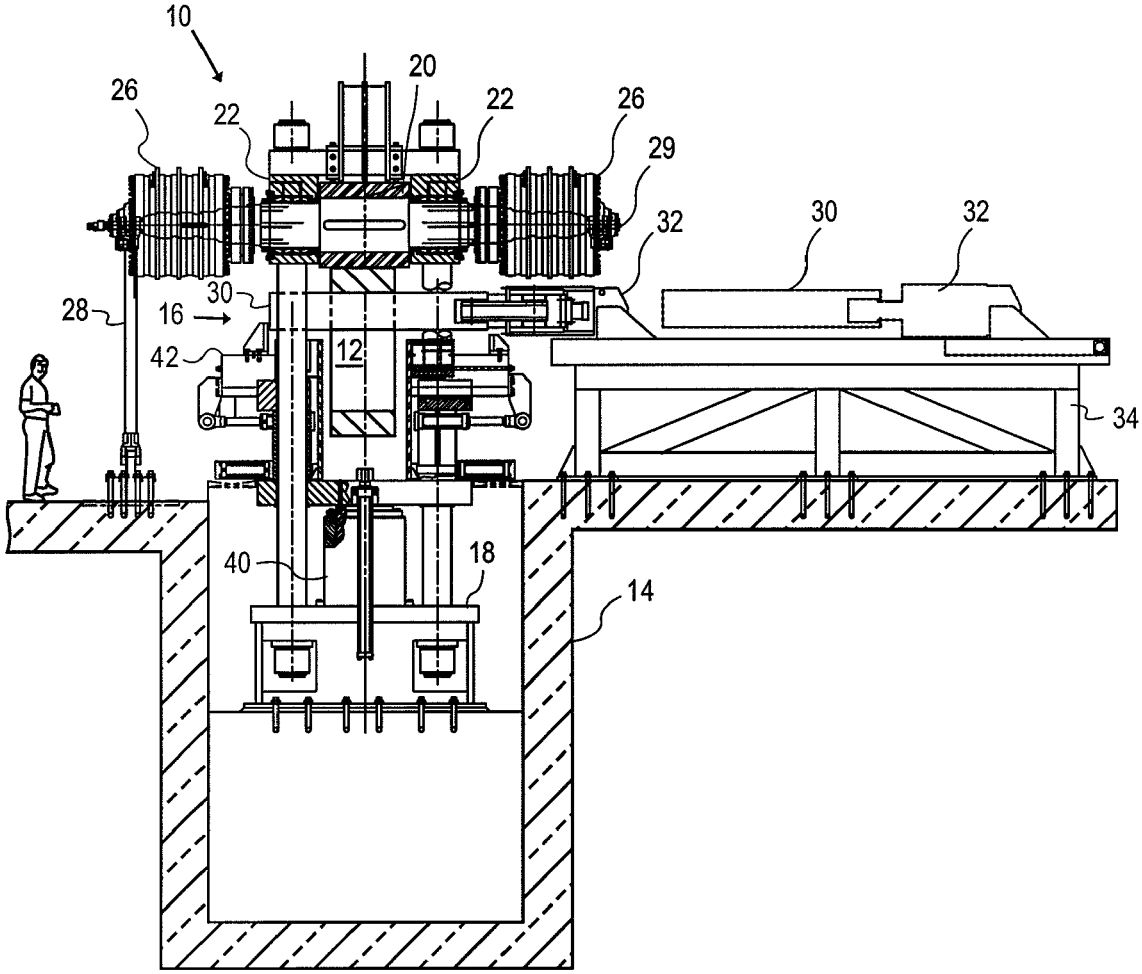
FIG. 1 is a front elevation view of a ring mill according to a preferred embodiment.
Figure 3:
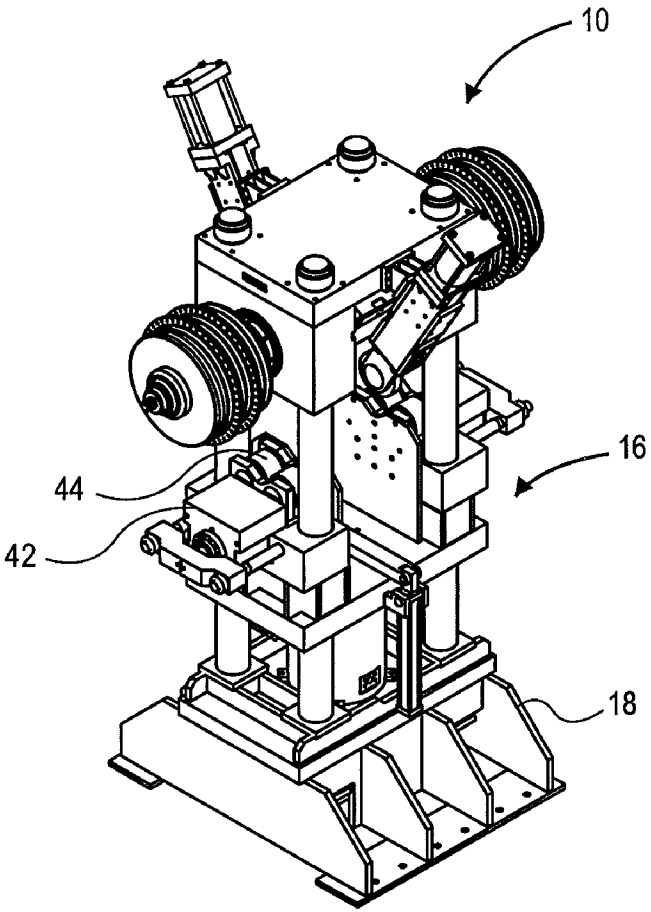
FIG. 3 is a perspective view of the ring mill.
Figure 2:
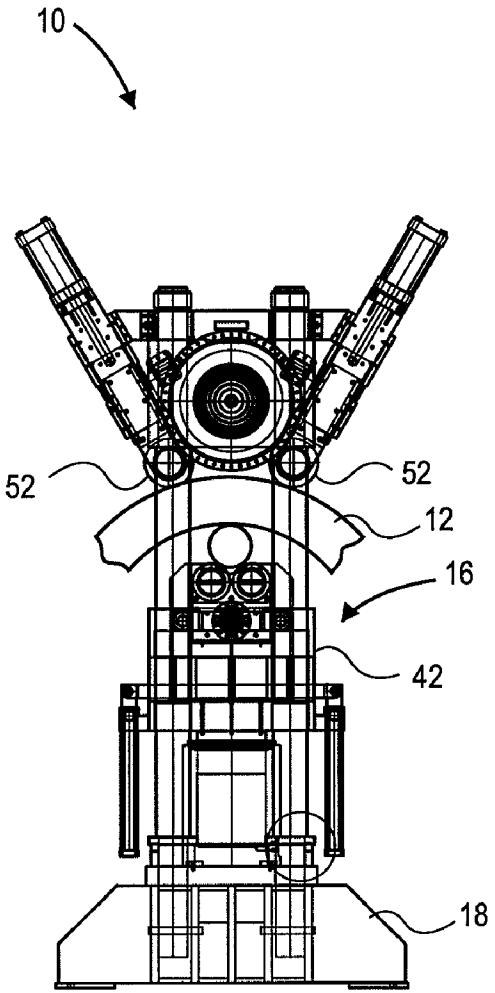
FIG. 2 is a side elevation view of the ring mill.

Some embodiments of the invention provide ring mill apparatus and method that utilize at least one direct drive motor to drive a roller. The direct drive motor can include for example a hydraulic motor, a brushless DC motor with a permanent magnet design with electronic switching, or a superconducting motor. Some embodiments more particularly use two opposed hydraulic motors. Some embodiments use the two opposed hydraulic motors to drive an upper king roller, which contacts the outside of the ring, and also use a lower mandrel roller, which contacts the inside of the ring. The lower mandrel roller in some cases may be laterally inserted inside the ring or retracted therefrom, and when inserted in a rolling position, is urged upwards against the ring by a ram driven carriage. In some examples, two hydraulic or other direct drive motors are provided in-line with the king roller. Also in some examples, an outer side of each hydraulic or other direct drive motor is restrained from rotation by a respective torque arm. Also in some embodiments, a pair of angled swing arms urge respective support rollers on the outside of the ring which may in some cases reduce vibration and/or oscillation of the ring. Some examples of the present invention will now be described with reference to the drawings figures in which like reference numerals refer to like parts throughout FIGS. 1 through 3 show a ring mill 10 according to one preferred apparatus and method, which can compress and rotate a ring 12, in order to expand the ring 12. A pit 14 supports a frame 16 with a base 18. The frame 16 supports a king roller 20 via rotational bearings 22. The king roller 20 has a central shaft 24 that projects out at each end to a respective direct drive motor 26.

As used herein, a direct drive motor is one that eliminates or reduces the requirements of a gearbox and/or coupling in a ring mill and/or a direct connection to the drive roller. Examples of direct drive motors include, but are not limited to, hydraulic motors, brushless DC motor (with a permanent magnet design and/or superconducting motors). In the following descriptions, an embodiment with a hydraulic motor as the motor 26 will be used by way of example.

Each hydraulic motor 26 is restrained by respective torque arms 28 and 29. Torque arm 28 is vertical and affixed to the pit. In order to avoid interference with other parts of the mill 10, the torque arm 29 is horizontal and affixed to a side wall. The torque arms 28 and 29 may include a threaded preload cylinder to preload the frame 16 to help stabilize the frame 16. The frame 16 supports the king roller 20 and the shaft 24 and hydraulic motors 26 at a constant height, and in a configuration so that the hydraulic motors 26 drive the king roller 20 to rotate it.

A mandrel roller 30 is held in a retracted position by a mandrel holder 32 which is slidably mounted for lateral translation to a support track 34. The mandrel holder 32 has clamps that releasably hold the mandrel roller 30. The mandrel roller 30 is translatable via the mandrel holder 32 between a retracted position (shown in broken lines) and an operative position (shown in solid line) under the ring 12. In the operative position, the mandrel holder 32 releases the mandrel roller 30 to allow the mandrel roller to be supported and driven upward by a mandrel carriage 42.

A hydraulic ram 40 is mounted to the base 18 and drives the mandrel carriage 42 vertically upward. The mandrel carriage 42 has rollers 44 that urge the mandrel roller 30 upward due to the ram force, thus providing a compressive force on the ring 12 by the king roller 20 and mandrel roller 30 and the rollers 44 allow the mandrel roller 30 to spin when the ring 12 is spinning due to rotation of the king roller 20.

The hydraulic or other direct drive motors provide several advantages in this embodiment compared to the prior art electric motor driven system. The hydraulic or other direct drive motors can be directly connected as shown to the king roller shaft, thus eliminating the need for expensive couplings and gear boxes. Also the hydraulic motors tend to accommodate the vibration which occurs during rolling better than the electric motor, gearbox, coupling system can without incurring the same costs and complexity.

The illustrated embodiment permits very large roller application such as for example greater than 2000 HP and 1000 tons of compressive force. As an example, a preferred hydraulic motor for each side may be a device obtained from the Hagglunds company. This motor is a low speed, high torque, radial piston, hydraulic motor, which can be used to drive the king roller shaft 24 without the need for a gearbox or coupling. The motor or motors are powered by a power system which creates and delivers pressurized fluid to the motor, for example, by a selected number of pumps, such as for example a gang of variable flow/variable pressure motorized plate pumps, feeding into a manifold connected to the motors.

In some embodiments, the mandrel roller 30 may be driven by the motors 26 instead of, or in addition to, driving the king roller 20.

FIGS. 2 and 3 further show a pair of stabilizing swing arms 50 mounted to the frame 16, which each urge a respective stabilizing roller 52 against the outside of the ring 12. These can also help reduce vibration of the ring 12, and can avoid or reduce, for example oscillations that can cause undesirable vibration upon reaching a natural harmonic frequency.

The example above uses a hydraulic motor as a direct drive application. Hydraulic motors and other direct drive motors can have many advantages when used in ring mills including, in some cases, cost, torque, RPM, vibration/shock resistance, complexity, energy use, durability, design flexibility and others. Other embodiments, therefore, include ring mills where a hydraulic or other direct-drive compatible motor are interrelated with a gearbox and/or coupling. Thus, for example, a hydraulic motor with a coupling and/or gearbox can fall within some embodiments of the invention. Another example would be where a hydraulic motor is implemented to simplify the design of a gearbox or coupling compared to the gearbox or coupling that would be regarded with a conventional brush type electric motor.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A system to expand a ring, comprising:

a king roller arranged to contact the outside of the ring;

a mandrel roller arranged to contact the inside of the ring;

a shaft connected to the king roller;

a drive system, having two hydraulic motors connected to the shaft, configured to rotationally drive the king roller; and a hydraulic ram configured to apply pressure between the king roller and the mandrel roller.

2. The system of claim 1, wherein the shaft has a first end and a second end, and the two hydraulic motors are connected to the shaft at the first end.

3. The system of claim 1, wherein the shaft has a first end and a second end and each end is connected to a respective one of the hydraulic motors.

4. The system of claim 1, wherein the two hydraulic motors are directly connected to the shaft.

5. The system of claim 1, wherein the shaft extends through the center of the king roller.

6. The system of claim 5, wherein the drive system further comprises a series of pumps that drives a respective hydraulic motor of the two hydraulic motors.

7. The system of claim 6, further comprising a torque arm attached to a respective hydraulic motor of the two hydraulic motors and configured to restrain the respective hydraulic motor.

8. The system of claim 7, wherein the hydraulic motors comprise radial piston hydraulic motors.

9. The system of claim 7, wherein the hydraulic motors comprise rotary motors.

10. The system of claim 7, wherein the hydraulic motors provide a combined output of at least 2000 HP.

11. The system of claim 1, further comprising a frame configured to support the mandrel roller and the hydraulic ram.

12. The system of claim 1, further comprising a frame configured to support the king roller and a pair of stabilizing arms configured to attach to the frame each having a respective stabilizing roller configured to contact the outside of the ring.

13. The system of claim 1, further comprising:

a roller holder removeably attached to the mandrel roller;

a support track moveably connected to the roller holder and configured to allow lateral movement of the roller holder and the mandrel roller between a retracted position for insertion and removal of the ring and an operative position for contacting the ring.

14. A system to expand a ring, comprising:

a king roller arranged to contact the outside of the ring;

a mandrel roller arranged to contact the inside of the ring;

a shaft connected to the mandrel roller;

a drive system, having two hydraulic motors connected to the shaft, configured to rotationally drive the mandrel roller; and a hydraulic ram configured to apply pressure between the king roller and the mandrel roller.

15. The system of claim 14, wherein the shaft has a first end and a second end, and the two hydraulic motors are connected to the shaft at the first end.

16. The system of claim 14, wherein the shaft has a first end and a second end and each end is connected to a respective one of the hydraulic motors.

17. The system of claim 14, wherein the two hydraulic motors are directly connected to the shaft.

18. The system of claim 14, wherein the shaft extends through the center of the mandrel roller.

19. The system of claim 18, wherein the drive system further comprises a series of pumps that drives a respective hydraulic motor of the two hydraulic motors.

20. The system of claim 19, further comprising a torque arm attached to a respective hydraulic motor of the two hydraulic motors and configured to restrain the respective hydraulic motor.

21. The system of claim 20, wherein the hydraulic motors comprise radial piston hydraulic motors.

22. The system of claim 20, wherein the hydraulic motors comprise rotary motors.

23. The system of claim 20, wherein the hydraulic motors provide a combined output of at least 2000 HP.

24. The system of claim 14, further comprising a frame configured to support at least a hydraulic ram.

25. An expanded ring made by a process, comprising the steps of:

contacting the outside of a ring with a king roller;

contacting the inside of the ring with a mandrel roller;

driving a shaft with a drive system having two hydraulic motors configured to rotationally drive the shaft;

driving one of the rollers with the driven shaft, the driven shaft configured to rotationally drive the king roller;

rotating the ring between the rollers; and applying pressure to the rotating ring with a hydraulic ram configured to apply pressure between the king roller and the mandrel roller.

26. The expanded ring made by the process of claim 25, further comprising the steps of:

moving the mandrel roller laterally to contact the ring; and releasing the mandrel roller from a roller holder.

27. The expanded ring made by the process of claim 26, further comprising the steps of:

attaching the mandrel roller to the roller holder; and moving the mandrel roller laterally to separate from the ring.

28. The expanded ring made by the process of claim 25, wherein applying pressure further comprises the step of urging the mandrel roller toward the king roller with the hydraulic ram.

29. The expanded ring made by the process of claim 25, wherein driving the shaft further comprises the step of applying at least 2000 HP of driving force, and wherein applying pressure further comprises the step of applying at least 1000 tons of compressive force.

30. The expanded ring made by the process of claim 25, further comprising the step of stabilizing the ring by urging a roller attached to a stabilizing swing arm against the ring.

31. An expanded ring made by a process, comprising the steps of:

contacting the outside of a ring with a king roller;

contacting the inside of the ring with a mandrel roller;

driving a shaft with a drive system having two hydraulic motors configured to rotationally drive the shaft;

driving one of the rollers with the driven shaft, the driven shaft configured to rotationally drive the mandrel roller;

rotating the ring between the rollers; and applying pressure to the rotating ring with a hydraulic ram configured to apply pressure between the king roller and the mandrel roller.

32. The expanded ring made by the process of claim 31, wherein applying pressure further comprises the step of urging the hydraulic ram toward the rollers.

33. The expanded ring made by the process of claim 31, wherein driving the shaft further comprises the step of applying at least 2000 HP of driving force, and wherein applying pressure further comprises the step of applying at least 1000 tons of compressive force.

34. A method of expanding a ring, comprising the steps of:

contacting the outside of the ring with a king roller;

contacting the inside of the ring with a mandrel roller;

driving a shaft with a drive system having two hydraulic motors configured to rotationally drive the shaft;

driving one of the rollers with the driven shaft, the driven shaft configured to rotationally drive the king roller;

rotating the ring between the rollers; and applying pressure between the rollers with a hydraulic ram.

35. The method of claim 34, further comprising the steps of:

moving the mandrel roller laterally to contact the ring; and releasing the mandrel roller from a roller holder.

36. The method of claim 35, further comprising the steps of:

attaching the mandrel roller to the roller holder; and moving the mandrel roller laterally to separate from the ring.

37. The method of claim 34, wherein applying pressure further comprises the step of urging the mandrel roller toward the king roller with the hydraulic ram.

38. The method of claim 34, wherein driving the shaft further comprises the step of applying at least 2000 HP of driving force, and wherein applying pressure further comprises the step of applying at least 1000 tons of compressive force.

39. The method of claim 34, further comprising the step of stabilizing the ring by urging a roller attached to a stabilizing swing arm against the ring.

40. A method of expanding a ring, comprising the steps of:

contacting the outside of the ring with a king roller;

contacting the inside of the ring with a mandrel roller;

driving a shaft with a drive system having two hydraulic motors configured to rotationally drive the shaft;

driving one of the rollers with the driven shaft, the driven shaft configured to rotationally drive the mandrel roller;

rotating the ring between the rollers; and applying pressure between the rollers with a hydraulic ram.

41. The method of claim 40, wherein applying pressure further comprises the step of urging the hydraulic ram toward the rollers.

42. The method of claim 40, wherein driving the shaft further comprises the step of applying at least 2000 HP of driving force, and wherein applying pressure further comprises the step of applying at least 1000 tons of compressive force.

* * * * *